United States Patent [19]

Wein

[11] Patent Number: 4,707,146

[45] Date of Patent: Nov. 17, 1987

[54] DISPLAY DEVICE FOR WRISTWATCHES AND WRISTBANDS

[76] Inventor: Irving L. Wein, 3750 N. Lake Shore Dr., Chicago, Ill. 60613

[21] Appl. No.: 849,432

[22] Filed: Apr. 8, 1986

[51] Int. Cl.[4] ..... G04B 37/00; A47F 7/00

[52] U.S. Cl. ..... 368/316; 248/116

[58] Field of Search ..... 368/316–317; 248/114–116

[56] References Cited

U.S. PATENT DOCUMENTS 1,315,326 9/1919 Palis ..... 248/115

2,549,369 4/1951 Epstein ..... 248/116

2,650,785 9/1953 Haister ..... 248/116

FOREIGN PATENT DOCUMENTS 203418 5/1959 Austria ..... 368/316

253885 12/1948 Switzerland ..... 248/116

*Primary Examiner*—Vit W. Miska

*Attorney, Agent, or Firm*—Sidney Wallenstein

[57] ABSTRACT

A display device for wristwatches and wristbands which is capable of being supported on a horizontal, or nearly horizontal, surface, or a vertical or slanted surface.

1 Claim, 6 Drawing Figures

DISPLAY DEVICE FOR WRISTWATCHES AND WRISTBANDS

TECHNICAL FIELD

The present invention relates to a display device for wristwatches and/or wristbands.

BACKGROUND OF THE PRIOR ART

Conventional devices for displaying wristwatches and wristbands generally comprise a curved wristwatch and wristband supporting member to the lower end of which is secured a base or foot member. Exemplary of such devices are those shown in U.S. Pat. Nos. 2,549,369, 4,082,183 and 4,216,858. The construction of conventional wristwatch and wristband display devices requires that they always be supported on a horizontal, or nearly horizontal, surface. whether that surface be located within a display case, or on a countertop. A retailer, therefore, is limited both as to the number, and the arrangement of, watches and/or bands that can be positioned in a display case or on a countertop. The restrictions thus placed upon a retailer of such items also limits his ability to display them in a manner which will best attract the attention of customers and enable them to best select the wristwatch and wristband they may wish to purchase.

BRIEF SUMMARY OF THE INVENTION

In accordance with the present invention, a display device for wristwatches and wristbands has been evolved which can be supported with equal facility on either a horizontal, or nearly horizontal, surface, or a vertical or slanted surface. In brief, the display device comprises a generally C-shaped, upwardly extending wristwatch and wristband retaining portion having a pedestal or base member joined to the lower end thereof and a panel engaging bracket-like member joined to the upper end thereof. The pedestal or base member enables the display device to be supported on a horizontal, or nearly horizontal, surface in a manner similar to conventional wristwatch and wristband display devices of the type shown in the aforementioned U.S. patents. The panel engaging bracket-like member, on the other hand, enables the display device to be supported, independently of the pedestal base member of the device, on a vertical or slanted surface. To this end, the bracket-like member is provided with extension means adapted to be detachably engaged in an opening or hole formed in a support panel. The support panel advantageously is provided with a plurality of such openings of holes, and can be free standing for use on a countertop, for example, or it can be secured to a wall or other supporting surface. The ability to arrange the display device of this invention in both vertically and horizontally aligned relation on such a panel gives a retailer extraordinary flexibility from the standpoint of being able to not only support an appreciable number of the devices on a panel, but, also, to do so in a manner which will be most appealing to customers, and will present to a purchaser a wider variety of items for his or her selection.

DETAILED DESCRIPTION OF THE INVENTION

Figure 1:
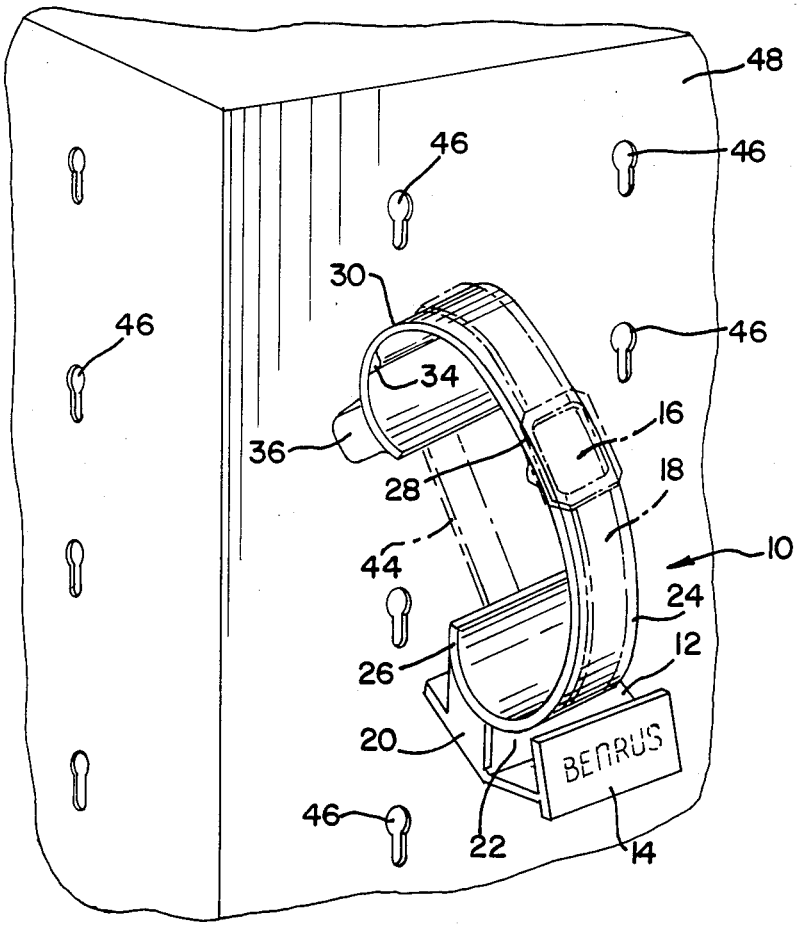
FIG. 1 is a view in perspective of an embodiment of the display device of the present invention supported on a panel, and having a wristwatch and band postioned therein.
Figure 2:
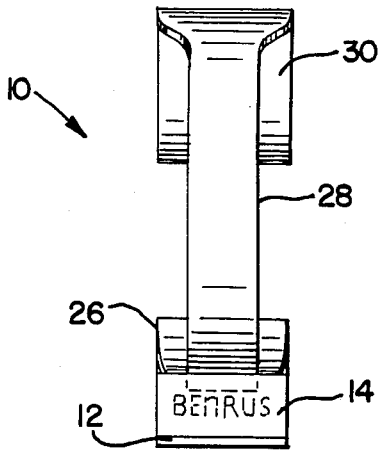
FIG. 2 is a front view in elevation of said embodiment of the invention.
Figure 3:
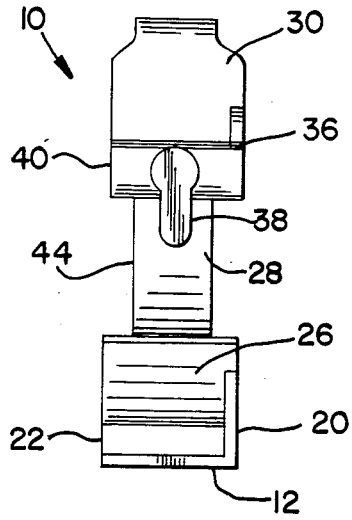
FIG. 3 is a rear view in elevation of said embodiment of the invention.

Referring, now, to the drawings, FIG. 1 shows a display device constructed in accordance with the present invention, and designated generally by reference numeral 10. The display device 10 is advantageously manufactured as a single molded piece from a suitable plastic material. As shown, the display device 10 has a generally L-shaped base member 12, provided with a face plate 14 extending from the front terminal edge of the base member 12. Face plate 14 can be used to display information concerning the identity, quality, and price of a wristwatch 16 and watchband 18 displayed on the device.

Integrally formed with a side edge of base member 12 is an upwardly-extending connecting wall 20, defining a lower passage 22 immediately above base member 12 and bordered on one side by connecting wall 20. An inverted, generally C-shaped member 24 is integrally formed at its bottom curved section 26, with the top face of connecting wall 20. Preferably, C-shaped member 24 is joined to the base member 12 at an angle whereby the bottom curved section 26 is forward of the upper curved section 30 of C-shaped member 24.

Figure 4:
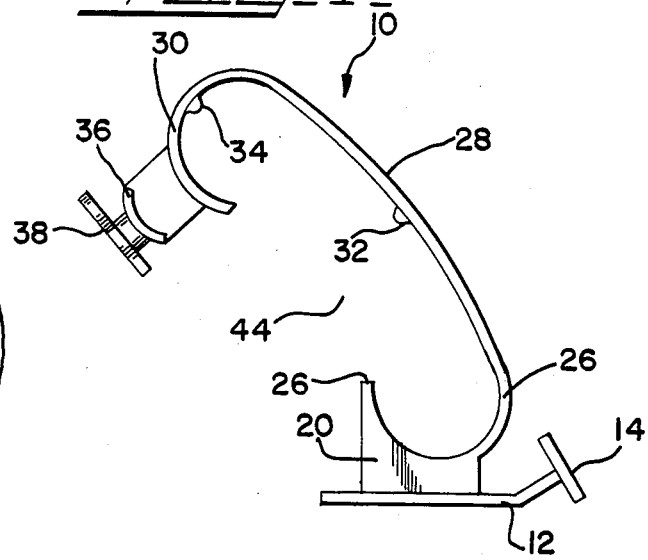
FIG. 4 is a side view in elevation of said embodiment of the invention.
Figure 6:
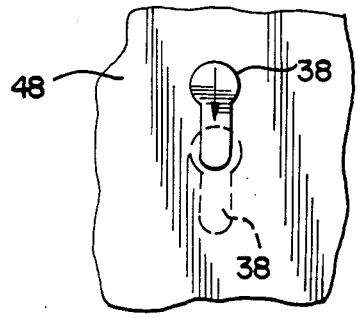
FIG. 6 is a sectional view taken substantially along line 6—6 of FIG. 5.

Bottom curved section 26 preferably tapers as it extends upward into the central section 28 of the C-shaped member 24. Central section 28 has sufficient width to allow wristwatch 16 and watch band 18 to be displayed while at the same time enabling the member to be flexed to accommodate wristbands of various lengths and types. The central section 28 of the member 24 widens into upper curved section 30. Further structural support for C-shaped member 24 can be provided by one or more reinforcement beads or bars 32 and 34 positioned on the internal side of C-shaped member 24 (See FIG. 4).

A generally U-shaped bracket-like member is integrally formed with the outer side edge of the upper curved section 30. The member 30 is provided with an extension 38. The extension 38 may have the configuration of a keyhole, as illustrated, or it may take the form of a headed stud, or be hook-like in shape. The positioning of member 36 with respect to the top curved section 30 creates an upper passage 40. The upper passage 40 and the lower passage 22 serve to permit lateral sliding of a watchband such as watchband 18 onto the C-shaped member 24. A watch band having a clasping or buckle closure can also encompass C-shaped member 24 by inserting one end of the watchband through lower passage 22, the other end of the band through upper passage 40, and engaging the clasp or buckle closure of the band, so that the band closure remains in the open section 44 of the C-shaped member 24.

Figure 5:
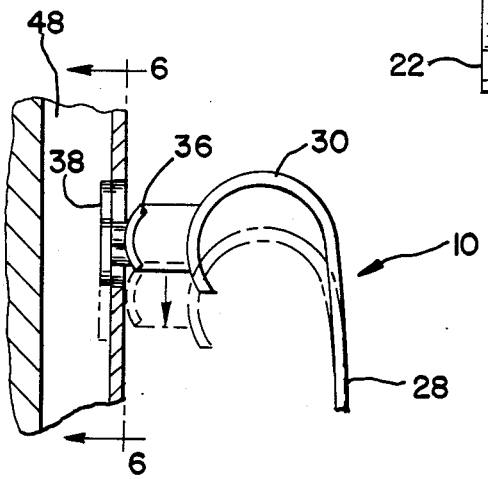
FIG. 5 is a fragmentary side view of said embodiment of the invention showing the extension means on the bracket-like member of the device being engaged in an opening formed in a panel.

As best shown in FIG. 5, the extension 38 of the bracket-like member 36 is matched with a keyhole opening 46 on a display panel 48, and is inserted through the opening 46 until the member 36 abuts the front face of the panel 48. By sliding the display device 10 in a downward direction, the extension will be behind panel 48 and will be detachably locked into position. To remove the display device 10 from the panel 48, the display device 10 is moved upwardly until the extension 38 is in register with the opening 46 in the panel 40, and is then separated from the panel.

The panel 48 desirably is provided with a plurality of spaced openings 46 as illustrated in FIG. 1, and, as indicated, can be freestanding, or be affixed to a wall.

While a specific embodiment of the invention has been illustrated and described, numerous modifications may come to mind without significantly departing from the spirit of the invention, and the scope of the protection is only limited by the scope of the accompanying claims.

What is claimed is:

1. A display device for effectively displaying either (a) a wristwatch with its associated watch band in largely extended and readily visible form, or (b) a wristband in largely extended and in readily visible form, comprising: a generally L-shaped base member having a front terminal edge and a side edge, a face plate extending from said front terminal edge, an upwardly-extending connecting wall formed along said side edge and defining a lower passage above said base member and bordered on one side by a connecting wall having a top face, an inverted generally C-shaped body portion having a bottom curved section and a top curved section, said bottom curved section being positioned on the top face of said connecting wall, said C-shaped body portion being positioned on said base member at an angle whereby said bottom curved section is forward of the top curved section of said C-shaped body portion, the central section of said C-shaped body portion having a width sufficient to allow a wristwatch and its associated watch band to be readily and visibly displayed while at the same time enabling said C-shaped body portion to be flexed to accommodate wristbands of various lengths and types, a generally U-shaped bracket positioned along an outer side member of said top curved section of said C-shaped body portion, said top curved section having an extension, a member positioned with said top curved section to form an upper passage, said lower and upper passages permitting lateral sliding of a watchband or a wristband onto said C-shaped body portion, said display device being supportable with essentially equal facility on either a horizontal, or a nearly horizontal, surface, or a vertical or slanted surface.

* * * * *